United States Patent [19]

Iwamoto

[11] 4,362,105

[45] Dec. 7, 1982

[54] SHEET DRAWING DEVICE FOR A SHEET-FED ROTARY PRESS

[75] Inventor: Masayuki Iwamoto, Shizuoka, Japan

[73] Assignee: Kabushiki Kaisha Shinoharatekkosho, Naganuma, Japan

[21] Appl. No.: 255,155

[22] Filed: Apr. 17, 1981

[51] Int. Cl.[3] ..... B41F 21/04; B65H 5/12; B65H 29/06

[52] U.S. Cl. ..... 101/410; 101/411; 101/230

[58] Field of Search ..... 101/230, 231, 409, 410, 101/411, 246; 271/82, 277, 275, 204, 206

[56] References Cited

U.S. PATENT DOCUMENTS

| | | | |
|---|---|---|---|
| 3,865,362 | 2/1975 | Luffy et al. | 101/410 X |
| 4,024,814 | 5/1977 | Becker | 101/230 X |
| 4,120,492 | 10/1978 | Černý | 101/230 |

*Primary Examiner*—J. Reed Fisher
*Attorney, Agent, or Firm*—C. O. Marshall, Jr.

[57] ABSTRACT

A sheet drawing device for a sheet-fed rotary press comprises a pair of adjusting gears adjustably mounted on a main shaft, a plurality of segment arms rotatably mounted on the main shaft, a bearing block adjustably mounted on each of the segment arms, which is pivotably mounted for adjustment about an axis perpendicular to the bearing axis of the bearing block, a sheet-drawing roll journaled in each bearing block, a plurality of fixtures secured to a gripper shaft which is pivotably mounted in the adjusting gears, each fixture being resiliently connected to a guide which is rotatably mounted on the gripper shaft and which carries a freely rotatable trailing-end gripping roller that is engageable with one of the sheet-drawing rolls, means for controlling pivoting of the gripper shaft to bring the trailing-end gripping rollers into and out of sheet gripping engagement with the sheet-drawing rolls, a second gripper shaft pivotably mounted in the adjusting gears, on which are secured a plurality of driving arms each of which carries a driving roller engaged in a recess in one of the sheet-drawing rolls, and means for controlling pivoting of the second gripper shaft, said means acting to take up slack in a sheet which is being gripped by the trailing-end gripping rollers, by driving the sheet-drawing rolls in the sheet-drawing direction.

1 Claim, 10 Drawing Figures

SHEET DRAWING DEVICE FOR A SHEET-FED ROTARY PRESS

This invention relates to a device for absorbing slack in a sheet being printed in a sheet-fed rotary press, particularly in its both-side printing operation.

For both-side printing in a conventional sheet-fed rotary press, there is employed a mechanism in which when the printing sheet P is transferred from a double-sized drum cylinder T2 (having a diameter double that of the sheet feed cylinder T1 and reversing cylinder T3) to the sheet reversing cylinder T3, the trailing end of the sheet P being printed is caught by the reversing grippers as shown in FIGS. 1 and 2 of the accompanying drawings. The double-sized drum cylinder T2 is provided with two units of leading end grippers 5 adapted to grip the leading end of the sheet P and two units of trailing end grippers 21, 37 designed to grip the trailing end of the sheet P. These gripper assemblies are so arranged that after the leading end grippers 5 have caught the leading end of the printing sheet P and received it from the preceding sheet feed cylinder T1, the trailing end grippers 21, 37 catch the trailing end of the sheet P. In this case, however, slack is produced in the gripped sheet P as a result of the printing operation by the preceding first printing unit I, so that if the sheet is fed on in its present form into the second printing unit II, there might occur misregister with preceding printing.

This invention has for its object to provide a device for absorbing slack in the sheet being printed until the sheet on the double-sized drum cylinder T2 is duly passed to the reversing cylinder T3, by improving the conventional sheet drawing mechanism, so as to obviate the possibility of mis-register in both-side printing by a sheet-fed rotary press.

According to the invention there is provided a sheet drawing device for a sheet-fed rotary press having a double-sized drum cylinder and sheet leading end grippers, the said device comprising sheet trailing end grippers mounted in such a drum for rear-ward movement during forward rotation of the drum to remove circumferential slack in a sheet gripped on the drum between the leading end grippers and the trailing end grippers.

To help understanding of the invention, a specific embodiment thereof will now be described with reference to the accompanying drawings in which.

Figure 1:
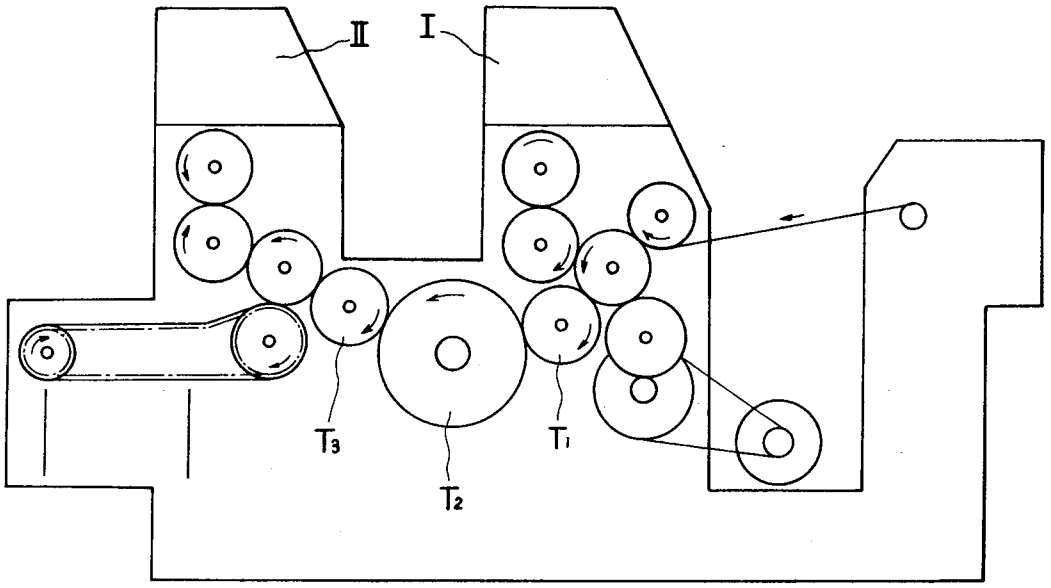
FIG. 1 is a general schematic drawing of a both-side printing machine incorporating a sheet drawing device according to the invention.
Figure 2:
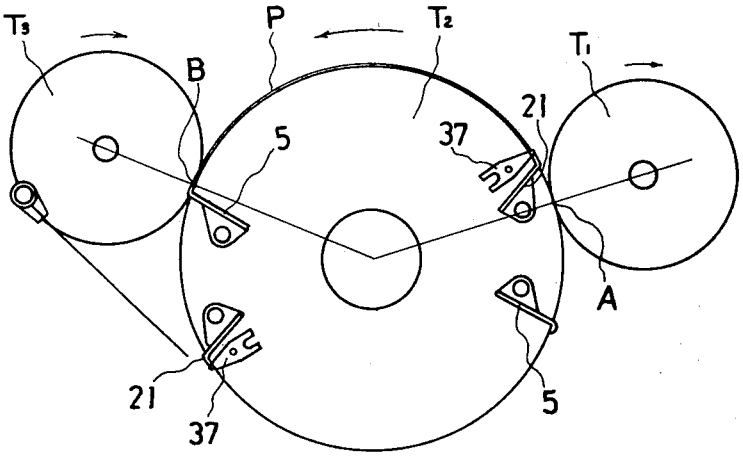
FIG. 2 is an enlarged sectional side view of the double-sized drum cylinder of the machine.
Figure 4:
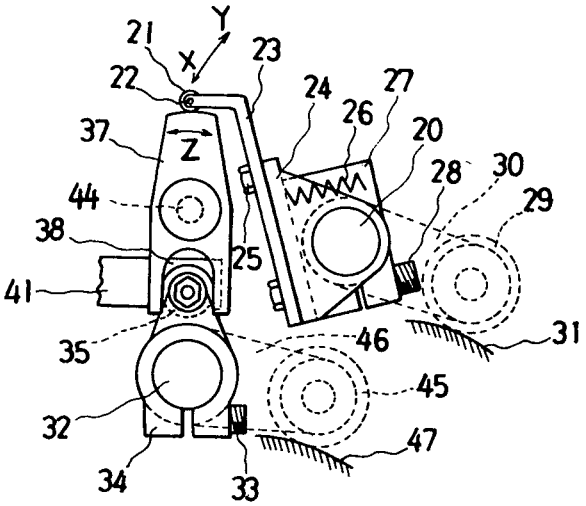
FIG. 4 is an enlarged side view of a sheet trailing end gripper assembly.
Figure 3:
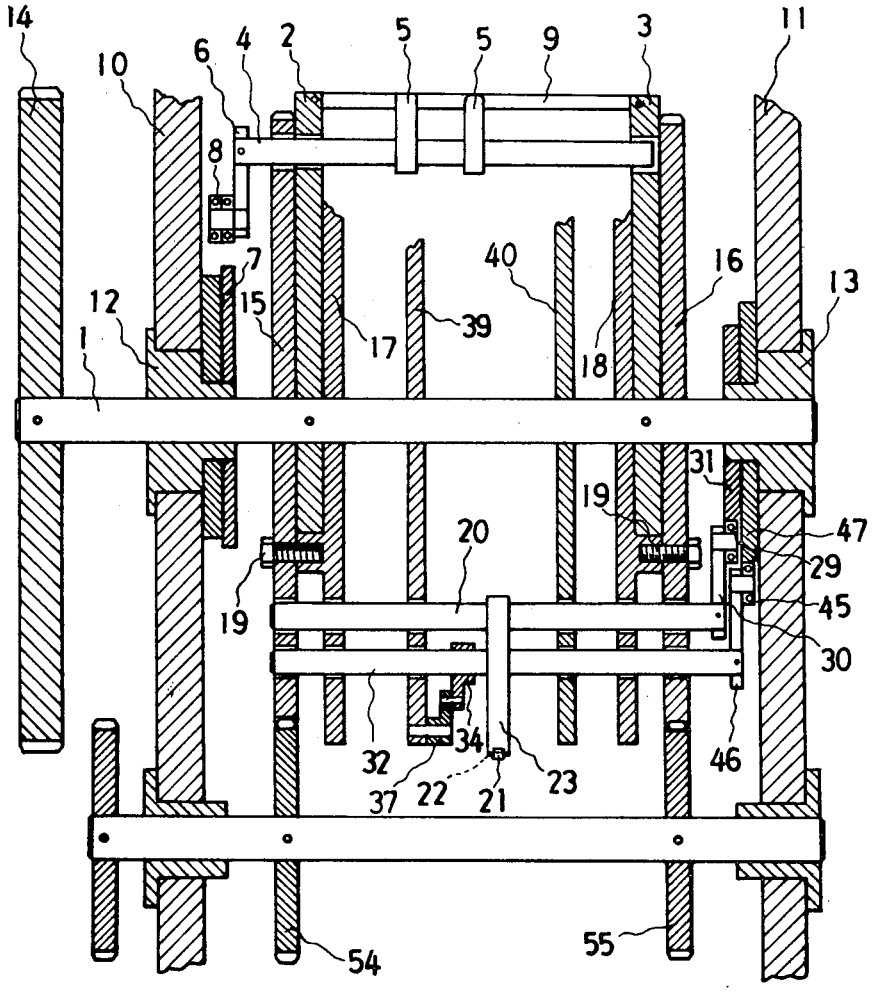
FIG. 3 is an enlarged sectional view along a part of the double-sized drum cylinder.

Referring first to FIGS. 1 to 3 of the drawings, numeral 1 indicates the main shaft of the double-sized drum cylinder T2, and numerals of 2 and 3 denote segment arms secured to both ends of the main shaft 1. A gripper shaft 4 is passed rotatably through the end portions of the respective segment arms 2,3, and a plurality of sheet leading end grippers 5 (of which only two are shown in FIG. 3) are secured to the shaft 4. An operating lever 6 for these grippers 5 is secured to the left end of the gripper shaft 4, the lever 6 having a cam roller 8 disposed to contact a leading end gripper control cam 7 secured to a frame 10. Also, a support 9 of the grippers 5 bridges the segment arms 2,3. The main shaft 1 is supported by the bearings 12, 13 in the respective end frames 10, 11 and arranged to be driven by a driving gear 14 secured to an end of the shaft. The segment arms 17, 18 for the sheet trailing end are secured by the respective screws 19, 19 to the adjusting gears 15, 16 mounted on the main shaft 1 outwardly of the segment arms 2, 3. Passed rotatably through the adjusting gears 15, 16 is a shaft 20 to which a fixture 27 is secured by a screw 28, see FIG. 4. Also, mounted rotatably on the shaft 20 is a guide 24, and a spring 26 is interposed between the guide 24 and fixture 27. A bar 23 is secured to the guide 24 by screws 25, the bar 23 carrying at its end a roll 21 for pressing the trailing end of the sheet P being printed, the roll 21 being rotatably supported by a pin 22. These components form one sides of trailing end gripper of which a plurality are provided although only one is shown in FIG. 3.

Figure 5:
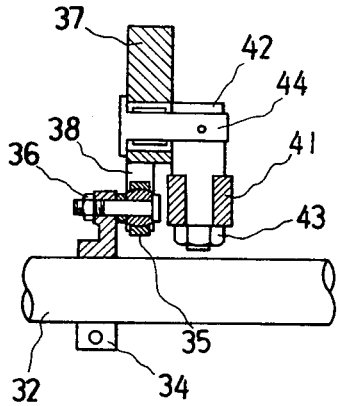
FIG. 5 is an enlarged sectional view thereof.
Figure 7:
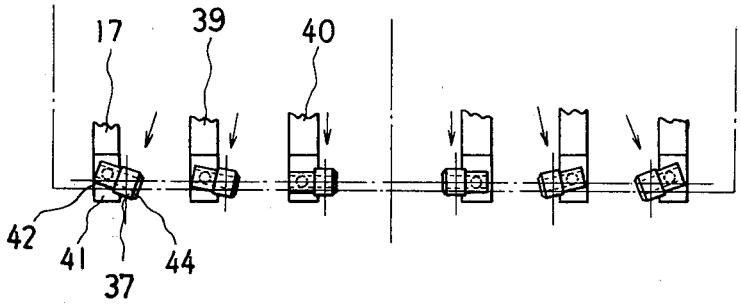
FIGS. 7 and 8 show the arrangement of the sheet drawing rolls in the sheet trailing end grippers.

Secured to an end of the shaft 20 is an operating lever 30 having a cam roller 29 which is in contact with a control cam 31 secured to the frame 11. Another shaft 32 is rotatably incorporated with the adjusting gears 15, 16. The other side of the trailing end grippers are comprised as follows, again only one gripper is shown in FIG. 3. A plurality of driving arms 34 are secured to the shaft 32 by screws 33. A roller 35 is secured to each driving arm 34 by a stud 36, the roller 35 being fitted in a groove or recess 38 in the sheet drawing roll 37 (see FIGS. 4 and 5). Blocks 42 are secured in different directions from each other to the protuberances 41 of the segment arms 17, 18 and 39, 40 by means of nuts 43, as shown in FIG. 7. Each sheet drawing roll 37 is arranged to be reciprocatively movable on the pin 44 secured to each block 42.

Figure 6:
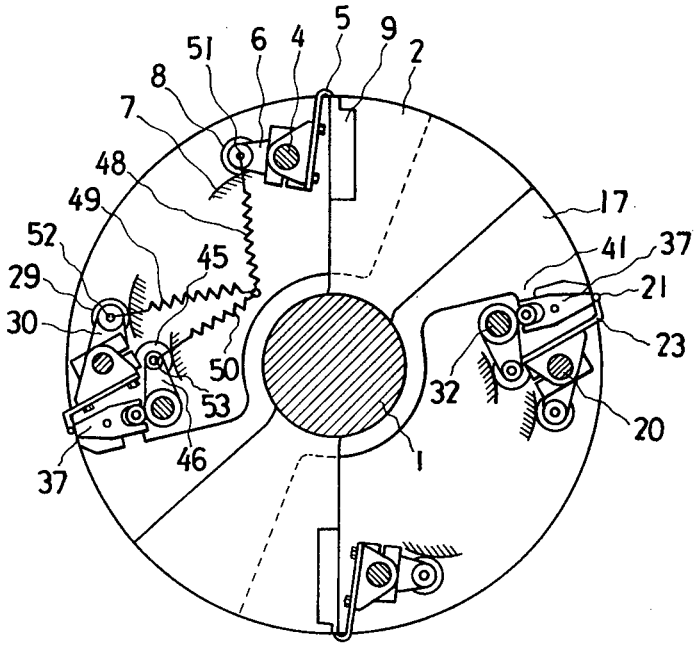
FIG. 6 is an enlarged side view of the sheet leading and trailing end grippers on the double-sized drum cylinder.

Secured to one end of the shaft 32 is a lever 46 provided with a cam roller 45 engaged with a control cam 47 fixed to the frame 11. Numerals 48, 49 and 50 (see FIG. 6) refer to the springs whereby the respective cam rollers 8, 29 and 45 disposed rotatably on the pins 51, 52 and 53 on the operating levers 6, 30 and 46 for the respective sheet leading end and trailing end grippers are pressed against the respective gripper control cams 7, 31 and 47. The adjusting gears 15, 16 are arranged to be rotated at the same speed as the main shaft 1 by the separately driven pinions 54, 55. Thus, arrangement is made such that the sheet trailing end grippers 21, 37 rotate at the same speed as the leading end grippers 5, and that the trailing end grippers 21, 37 roll on the main shaft 1 when adjustment is made in correspondence to a change in size of the printing sheet.

Now, the above-described embodiment of this invention is further explained from its operational aspect.

When the cam roller 8 of the operating lever 6 comes into contact with the protuberance of the control cam 7 on rotation of the main shaft 1, the sheet leading end grippers 5 catch the leading end of the sheet P being printed and receive it at the sheet transfer point A from the preceding sheet feed cylinder T1 and further continue to turn. When the trailing end of the sheet P has arrived at the sheet transfer point A, the sheet trailing end pressing roll 21 adjusted to the length of the sheet grips the trailing end of the sheet P between it and the sheet drawing roll 37 by the action of the control cam 31. Thus, when the cam roller 29 of the operating lever 30 secured to the shaft 20 stays at the low portion of the control cam 31, the fixture 27 secured to the shaft 20 moves the guide 24 in the direction Y (see FIG. 4), so that the sheet trailing end pressing roll 21 separates from the upper side of the sheet drawing roll 37. As the cam roller 29 turns gradually along the height of the control cam 31 on rotation of the main shaft 1, the lever 30 is turned to rotate the shaft 20. Accordingly, the sheet trailing end pressing roll 21 turns in the direction X about the main shaft 20 and the sheet is held against the sheet drawing roll 37 after the cam roller 29 reaches the highest part of the control cam 31 coinciding with the sheet transfer point A. The sheet holding pressure is decided independently by the spring 26.

Since the height of the control cam 47 rises gently before the trailing end of the sheet P held by the grippers 21, 37 reaches the sheet transfer point B of the reversing cylinder T3, that is to say, after the sheet trailing end pressing roll 21 holding the trailing end of the printing sheet P has passed the sheet transfer point A, the shaft 32 is turned by the cam roller 45 contacting the cam 47 through the lever 46. This causes corresponding swinging movement of the driving arm 34 secured to the shaft 32, and hence the sheet drawing roll 37 fitted with the roller 35 mounted to the driving arm 34 is urged to turn in the direction Z about the pin 44. Thus, the sheet P held between the sheet drawing roll 37 and sheet trailing end pressing roll 21 is pulled rearwardly.

A principal concern in this embodiment of the invention is the fact that the condition of slack of the printing sheet at the time of receipt thereof by the double-sized drum cylinder T2 is not constant; the extent and direction of slack are widely variable depending on the particulars of the printing operation (for example difference in ink-deposited area), size of the sheet P being printed, its quality etc.

So, the amount of pulling of the sheet P by its grippers 21, 37 is set based on the tolerance of slack empirically determined under the worst conditions, and arrangement is made such that when the amount of slack is below the set value, such slack is absorbed before movement of the sheet drawing roll 37 ends. Thus, the sheet P held between the sheet drawing roll 37 and sheet end pressing roll 21 is allowed to move in that state while the slack exists, but upon elimination of slack, slippage occurs between the sheet P and the sheet drawing roll 37. Therefore, as regards the shape of the sheet trailing end pressing roll 21, cylindrical form is more advantageous than flat form as the former is easier to slide. Needless to say, the sheet leading end grippers 5 keep holding the sheet P.

Another important fact noted here is that when the printing sheet P is held by the pressing roll 21, slack develops not only in the circumferential direction but also in the axial direction, so that where the pressing roll 21 and the sheet drawing roll 37 are arranged parallel to the axial direction, although slack in the circumferential direction can be eliminated, it is not possible to perfectly absorb slack in the axial direction.

Figure 8:
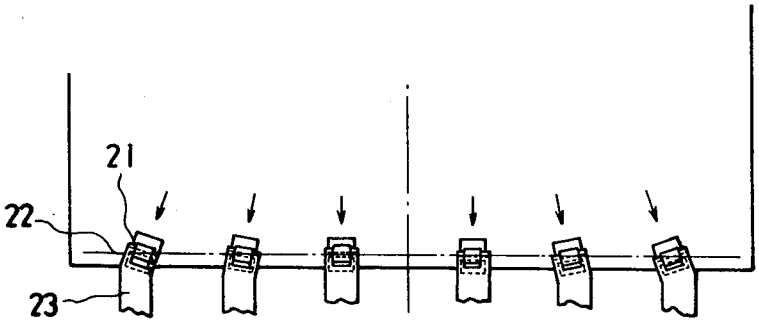
Figure 9:
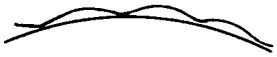
FIG. 9 is a drawing illustrating circumferential slack of the printing sheet.
Figure 10:
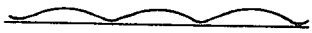
FIG. 10 is a drawing illustrating axial slack of the printing sheet.

In this embodiment of the invention, therefore, a plurality of sheet trailing end pressing rolls 21 and sheet drawing rolls 37 are arranged radially and symmetrically on both sides of the axial centre line of the machine as shown in FIGS. 7 and 8. This arrangement allows perfect absorption of any irregular slack in either circumferential or axial direction or in both directions. In order to ensure smooth turn of the radially arranged sheet drawing rolls 37, a freely movable roller 35 is provided between each driving arm 34 and corresponding sheet drawing roll 37.

Having the above-described structural arrangements, this embodiment can produce the following effects.

When slack of the sheet P being printed is removed by the sheet trailing end grippers 21, 37 after the sheet leading end grippers 5 of the double-sized drum cylinder T2 have received the sheet P from the sheet feed cylinder T1, the sheet is pulled by the movements of the sheet drawing rolls 37 and sheet pressing rolls 21, and after removal of slack, the sheet slips. Also, removal of slack of the sheet is facilitated by the particular arrangement of the rolls 21 and 37 which are arranged with gradually differing angles symmetrically on both sides of the central axial line of the machine. Therefore, any form of slack of the sheet can be surely absorbed irrespective of size and thickness of the sheet, substance of printing, etc. As for the sheet pulling rate by the sheet drawing rolls 37, there is much time allowance for such operation as it is merely required to complete pulling of the sheet by the time when the sheet trailing end pressing rolls 21, which have caught and held the trailing end of the sheet P at its transfer point A, arrive at the sheet transfer point B, and this allows gentle pulling of the sheet. This proves advantageous particularly when the sheet is thin. In the conventional devices there is employed a mechanism in which a plurality of suction ports are provided in the axial direction to hold in position the trailing end of the sheet by vacuum air but in the case of a sheet-fed type printer, particularly when it is used for printing the thick sheets (0.4–0.5 mm thick), the sheet does not easily get to fit the control of the printing cylinder or sheet feed cylinder, and there is produced a fairly strong repulsive force which urges the trailing end of the sheet to return to the flat state. Therefore, in case of using such thick printing sheet of which the trailing end needs to be caught and held by the sheet trailing end grippers on the double-sized drum cylinder T2 for both-side printing, it is more advantageous to employ a system in which the sheet is held down from above with a force overwhelming the repulsive force than a system in which the underside of the sheet is absorbed by vacuum air to keep its form.

I claim:

1. A sheet drawing device for a sheet-fed rotary press comprising a main shaft, a pair of primary segment arms secured in spaced relation on the main shaft, a plurality of front-end grippers secured to a first gripper shaft which is pivotally mounted in said segment arms, means for controlling pivoting of said gripper shaft to operate said grippers, a pair of adjusting gears adjustably mounted on the main shaft, and a plurality of secondary segment arms rotatably mounted on the main shaft, wherein the improvement comprises a bearing block adjustably mounted on each of the secondary segment arms, which is pivotably mounted for adjustment about an axis perpendicular to the bearing axis of the bearing block, a sheet-drawing roll journaled in each bearing block, a plurality of fixtures secured to a second gripper shaft which is pivotably mounted in the adjusting gears, each fixture being resiliently connected to a guide which is rotatably mounted on the second gripper shaft and which carries a freely rotatable trailing-end gripping roller that is engageable with one of the sheet-drawing rolls, means for controlling pivoting of the second gripper shaft to bring the trailing-end gripping rollers into and out of sheet gripping engagement with the sheet-drawing rolls, a third gripper shaft pivotably mounted in the adjusting gears, on which are secured a plurality of driving arms each of which carries a driving roller engaged in a recess in one of the sheet-drawing rolls, and means for controlling pivoting of the third gripper shaft, said means acting to take up slack in a sheet which is being gripped by the front-end grippers and the trailing-end gripping rollers, by driving the sheet-drawing rolls in the sheet-drawing direction.

* * * * *